US012692769B2

(12) United States Patent
Spalder et al.

(10) Patent No.: US 12,692,769 B2
(45) Date of Patent: Jul. 28, 2026

(54) SUPPORT SYSTEMS FOR SUBSEA WELLBORES

(71) Applicant: OneSubsea AS, Oslo (NO)

(72) Inventors: Brynjulf Spalder, Tranby (NO); Rolf Barfod Schüller, Tranby (NO)

(73) Assignee: OneSubsea AS, Oslo (NO)

( * ) Notice: Subject to any disclaimer, the term of this patent is extended or adjusted under 35 U.S.C. 154(b) by 0 days.

(21) Appl. No.: 19/344,267

(22) Filed: Sep. 29, 2025

(65) Prior Publication Data

US 2026/0092509 A1 Apr. 2, 2026

Related U.S. Application Data

(60) Provisional application No. 63/701,950, filed on Oct. 1, 2024.

(51) Int. Cl.
*E21B 41/08* (2006.01)

(52) U.S. Cl.
CPC ..... *E21B 41/08* (2013.01)

(58) Field of Classification Search
CPC ..... E21B 41/08
See application file for complete search history.

(56) References Cited

U.S. PATENT DOCUMENTS

| | | | | | |
|---|---|---|---|---|---|
| 3,618,661 | A * | 11/1971 | Peterman | E21B 41/08 175/7 |
| 3,744,561 | A * | 7/1973 | Shatto, Jr. | E21B 41/0014 166/359 |
| 4,192,383 | A * | 3/1980 | Kirkland | E21B 43/017 166/341 |
| 4,784,527 | A | 11/1988 | Hunter | |
| 5,526,882 | A | 6/1996 | Parks | |
| 2006/0054328 | A1* | 3/2006 | Paulson | E21B 41/08 166/345 |
| 2018/0163518 | A1* | 6/2018 | Reznicek | E21B 41/08 |
| 2019/0376250 | A1* | 12/2019 | Grytdal | B63B 21/502 |

FOREIGN PATENT DOCUMENTS

| | | | | |
|---|---|---|---|---|
| GB | 2214897 A * | 9/1989 | | B66F 3/24 |
| GB | 2541005 A * | 2/2017 | | E21B 41/0014 |

* cited by examiner

*Primary Examiner* — James G Sayre
(74) *Attorney, Agent, or Firm* — Kyle R. Miiller

(57) ABSTRACT

An embodiment of a subsea support system comprises a foundation including a frame and an elongate connection pile. In addition, the subsea support system comprises a template that is configured to be lowered to the sea floor separately from the foundation. The template includes one or more slots, each of the one or more slots being configured to position a subsea wellbore on the sea floor. In addition, the template includes a connection sleeve that is arranged so that when the template is landed on the foundation on the sea floor, the connection pile is received in the connection sleeve.

19 Claims, 10 Drawing Sheets

SUPPORT SYSTEMS FOR SUBSEA WELLBORES

CROSS-REFERENCE TO RELATED APPLICATIONS

This application claims the benefit of and priority to U.S. Provisional Patent application No. 63/701,950, filed Oct. 1, 2024, and entitled "Subsea Structure with Interlocking Modules," which is incorporated herein by reference in its entirety.

BACKGROUND

Embodiments disclosed herein are generally directed to subsea structures for offshore wellbores, and in particular to support systems that are configured to support and position one or more wellbores on the sea floor.

A wellbore may be formed in a subterranean formation to access resources, such as hydrocarbons, water, or other minerals. Some wellbores may be located in an offshore location, so that drilling, production, and maintenance operations for such wellbores involves traversing through a subsea environment. Such offshore wellbores may include various systems, components, and devices that are positioned on or near the sea floor. For instance, the wellbore may include a wellhead that serves as an interface between surface equipment and the wellbore.

In some circumstances, a subsea template may be secured to the sea floor that is configured to act as a guide for positioning one or more wellbores on the sea floor. In addition, the subsea template may be configured to support and align the various subsea structures that are associated with the wellbores.

SUMMARY

Some embodiments disclosed herein are directed to a subsea support system. The subsea support system includes a foundation further including a frame and an elongate connection pile. In addition, the subsea support system includes a template that is configured to be lowered to a sea floor separately from the foundation. The template includes one or more slots, each of the one or more slots being configured to position a subsea wellbore on the sea floor. In addition, the template includes a connection sleeve that is arranged so that when the template is landed on the foundation on the sea floor, the connection pile is received in the connection sleeve.

Some embodiments disclosed herein are directed to a method of installing a subsea support system. The method includes (a) lowering a foundation to a sea floor, where the foundation includes a frame and (b) securing the foundation on the sea floor so that the foundation is configured to resist loads in a vertical direction and a lateral direction. In addition, the method includes (c) lowering a template to the sea floor after (a), where the template includes one or more slots, each of the one or more slots being configured to position a subsea wellbore on the sea floor. Further, the method includes (d) landing the template on the frame of the foundation. Still further, the method includes (e) forming a mechanical lock between the template and the foundation after (d) to rigidly secure the template to the foundation.

Some embodiments disclosed herein are directed to a subsea support system. The subsea support system includes a frame and a plurality of vertically extending connection piles. In addition, the subsea support system includes a template landed on the frame of the foundation. The template includes a plurality of slots that are each configured to position a subsea wellbore on a sea floor. In addition, the template includes a plurality of connection sleeves. The plurality of vertically extending connection piles are inserted into the plurality of connection sleeves to align the template on the foundation. Further, the subsea support system includes a plurality of mechanical locks formed between the plurality of connection piles and the plurality of connection sleeves to rigidly secure the template to the foundation.

BRIEF DESCRIPTION OF THE DRAWINGS

For a detailed description of various exemplary embodiments, reference will now be made to the accompanying drawings in which.

DETAILED DESCRIPTION

Figure 1:
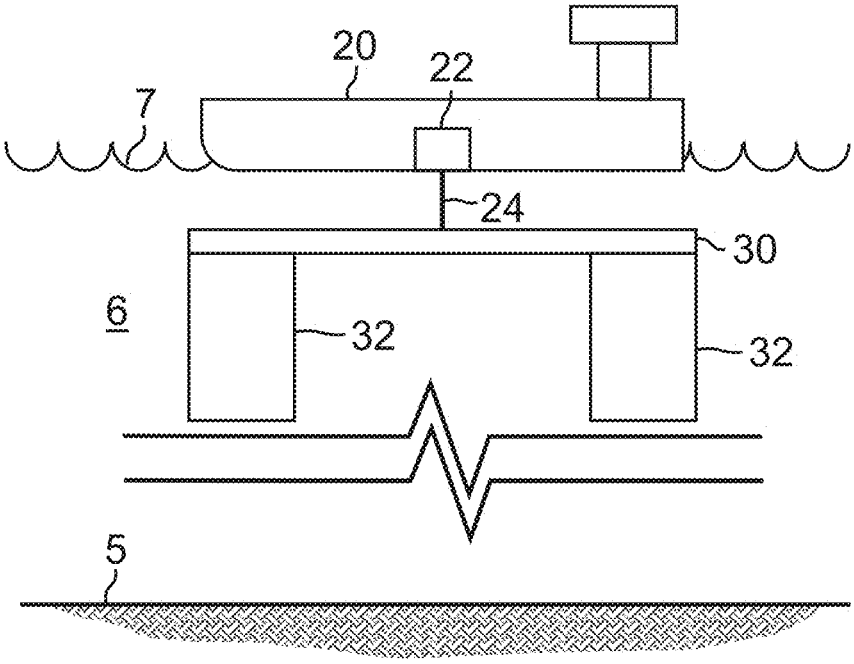
FIGS. 1-4 are sequential, schematic views of a method of installing a support system for one or more subsea wellbores on the sea floor according to some embodiments disclosed herein.
Figure 2:
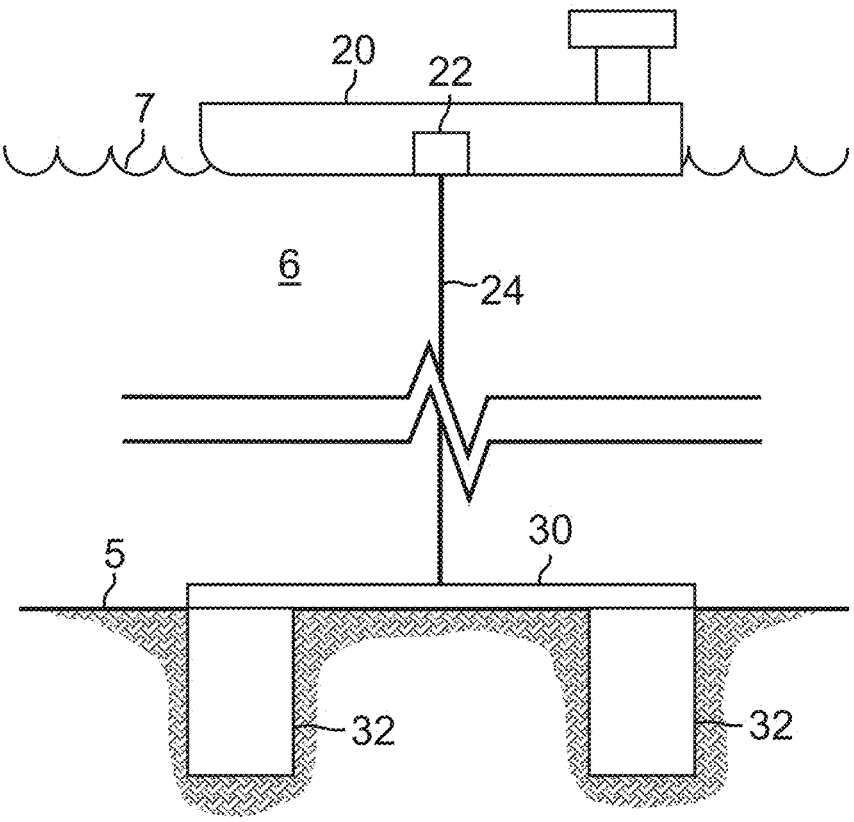

A subsea template may be landed on the sea floor to provide a guide for drilling one or more wellbores, and to support one or more subsea structures associated with the one or more wellbores. For example, a subsea template may include one or more slots that are configured to provide a guide for drilling the wellbores into the sea floor, and that are configured to at least partially support the wellheads and other components associated therewith.

A subsea template may include a suitable foundation that is configured to secure the template to the sea floor and resist loads. For example, the template may experience both vertical and lateral (or horizontal) loads due to the weight of the subsea equipment and movement of a surface vessel that may be coupled to one or more of the wellbores (such as via a riser pipe). In addition, such loads on the template may also be caused by drilling operations and in-place loading situations such as tie-ins, fishing operations, and thermal expansion and contraction of pipelines during either shutdown or startup of operations.

However, the integration of a suitable foundation for resisting these various loads adds considerable weight and bulk to the subsea template so that lifting and lowering operations for a subsea template may be difficult to perform. For instance, if the sea floor at the offshore location is particularly soft, relatively long suction anchors may be utilized to sufficiently stabilize the subsea template. These enlarged components cause a significant increase in weight for the overall system. Indeed, such subsea templates may have a total installation weight that is at or above a maximum allowable weight for many cranes or other lifting systems on offshore vessels.

Accordingly, embodiments disclosed herein are directed to subsea support systems for subsea wellbores that include a subsea template and a foundation that may be lowered to the sea floor separately from one another. In some embodiments, the foundation may include one or more structures or components that are configured to engage with the sea floor to resist the various loads previously described above (such as vertical and horizontal loads). The template may be landed on top of the foundation in a separate lifting operation. Once the template is landed on the foundation, a suitable mechanical lock may be formed, defined, or engaged therebetween so that subsequent loads borne by the template may be readily transferred to the foundation and ultimately the sea floor. Thus, by use of the embodiments disclosed herein, a subsea support system may sufficiently support one or more wellbores on a sea floor comprised of softer soils and may avoid the increased lifting weights that may be typically associated with the installation of such systems.

Referring now to FIGS. 1-4, a process of installing a subsea support system 40 (FIG. 4) for one or more subsea wellbores on the sea floor 5 is shown according to some embodiments. The subsea support system 40 ("support system 40") may include foundation 30 and a template 50 that may be lowered to the sea floor 5 separately from one another to reduce a weight borne by lifting devices (such as lifting system 22) at the sea surface 7 during installation. In some embodiments, the template 50 may be configured to align and position a plurality of wellbores that may be drilled into the sea floor 5 after installation of the support system 40 according to embodiments described herein.

Referring first to FIG. 1, the foundation 30 may be lowered from a surface vessel 20 below the sea surface 7 and into the subsea environment 6. The surface vessel 20 may comprise a ship, barge, platform, any other suitable type of surface vessel, or combinations thereof. In some embodiments, a plurality of surface vessels may be used to lower one or more of the foundation 30 and template 50 to the sea floor 5. The surface vessel 20 may include a lifting system 22, such as one or more cranes, draw works, etc. that is configured to lift or lower objects, structures, etc. via one or more lines 24. As shown in the sequence from FIG. 1 to FIG. 2, the foundation 30 may be connected to the line(s) 24 and lowered toward the sea floor 5 through the subsea environment 6 via the lifting system 22 on the vessel 20.

The foundation 30 may include one or more devices or structures that are configured to secure or engage the foundation 30 with the sea floor 5. For instance, the foundation 30 may include one or more piles, suction anchors, mud mats, or combinations thereof. In the embodiment illustrated in FIGS. 1-4, the foundation 30 includes a plurality of suction anchors 32. The suction anchors 32 may comprise a housing or caisson that is open on the lower end. With specific reference to FIG. 2, as the foundation 30 is lowered onto the sea floor 5, the suction anchors 32 are at least partially driven or sunk into the sea floor 5. Thereafter, fluid (such as sea water) is pulled out of the upper end of the suction anchor 32 (such as via one or more pumps or other suitable vacuum sources) to suck or pull the anchors 32 into the sea floor 5. Pulling the suction anchors 32 into the sea floor 5 may secure the foundation 30 in place so that the foundation may be configured to resist loads in the vertical direction (that is, aligned with the force of gravity), horizontal direction (that is, perpendicular to the force of gravity), and directions therebetween. The length, such as the vertical length (or height), of the suction anchors 32 may be selected to provide sufficient stabilization for the foundation 30 (and thus also the template 50) based on the composition of the sea floor 5. As an example, the vertical length of the suction anchors 32 may be increased to provide a sufficient stabilization in softer soils.

Figure 3:
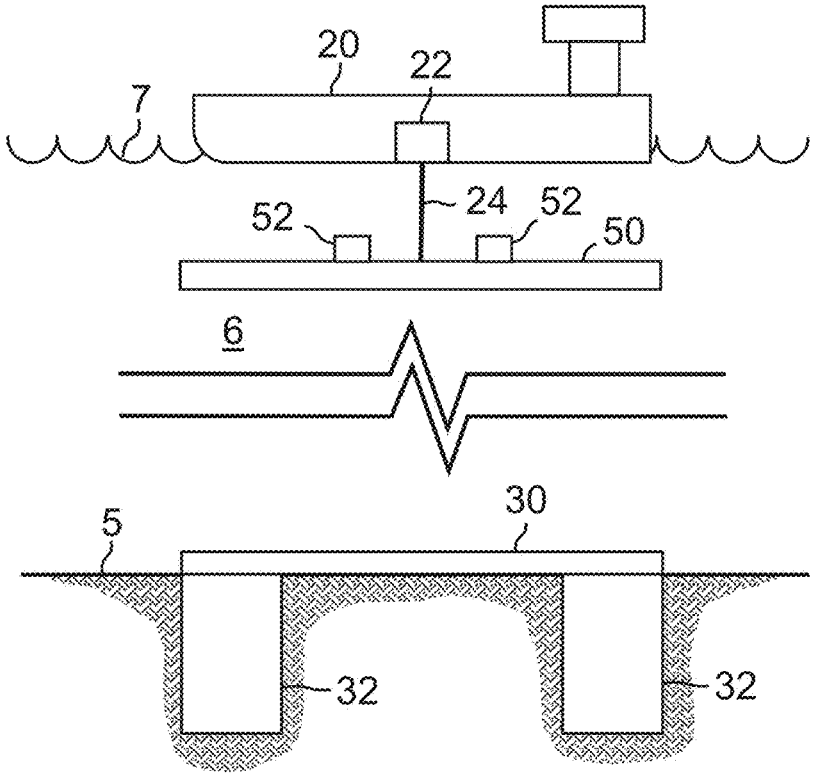
Figure 4:
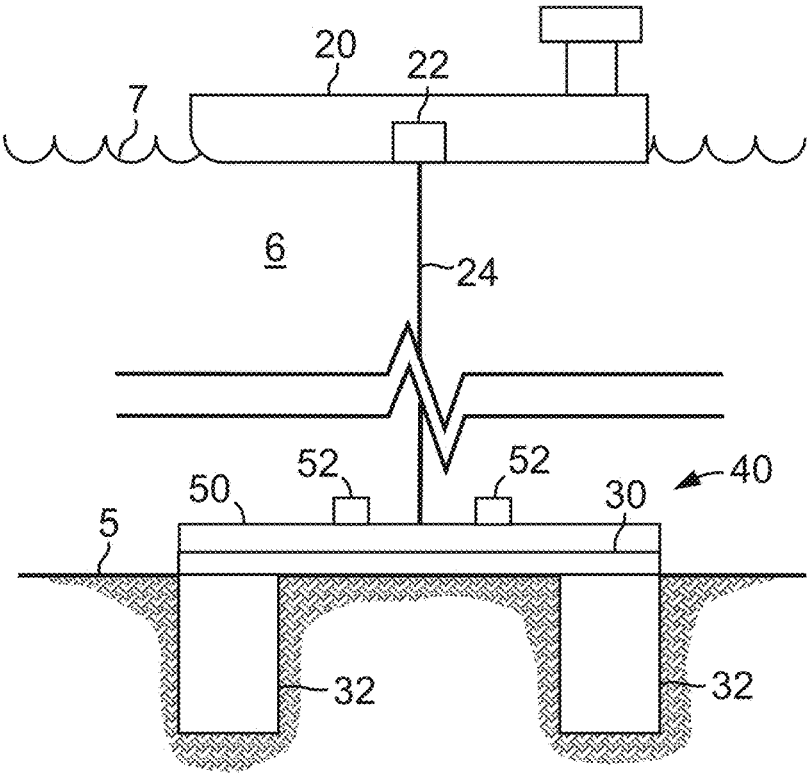

As shown in FIGS. 3 and 4, after the foundation 30 is secured to the sea floor 5, the template 50 may be lowered via the lifting system 22 (and line(s) 24) of vessel 20 to land on top of the foundation 30. In some embodiments, a different surface vessel and/or a lifting system vessel (that is, different from the surface vessel 20 and/or lifting system 22) may be used to lower the template 50 toward the foundation 30 on the sea floor 5.

As will be described in more detail herein, once the template 50 is landed on the foundation 30, one or more mechanical locks may be engaged in order to rigidly secure the template 50 to the foundation 30 and allow any loads (such as vertical and/or horizontal, etc.) to be readily transferred between the template 50 and foundation 30 thereafter.

The template 50 may include one or more (such as one or a plurality of) slots 52 that are each configured to position a wellbore (not shown) on the sea floor 5 during operations. In addition, each of the slots 52 may be configured to at least partially support one or more components or structures that are associated with the corresponding wellbore, such as a valve tree (e.g., a Christmas valve tree), blow out preventer (BOP), riser connection, etc. In some embodiments, the template 50 may also support other components, such as one or more manifolds, pumps, or other equipment.

Referring specifically to FIG. 4, once the template 50 is landed on and rigidly secured to the foundation 30, the template 50 and foundation 30 may define the support system 40 on the sea floor 5. The support system 40 may be configured to position and align one or more wellbores (not shown) in the sea floor 5. In addition, the support system 40 may be configured to support one or more surface structures associated with the wellbore(s) (such as any of those previously described above).

Figure 5:
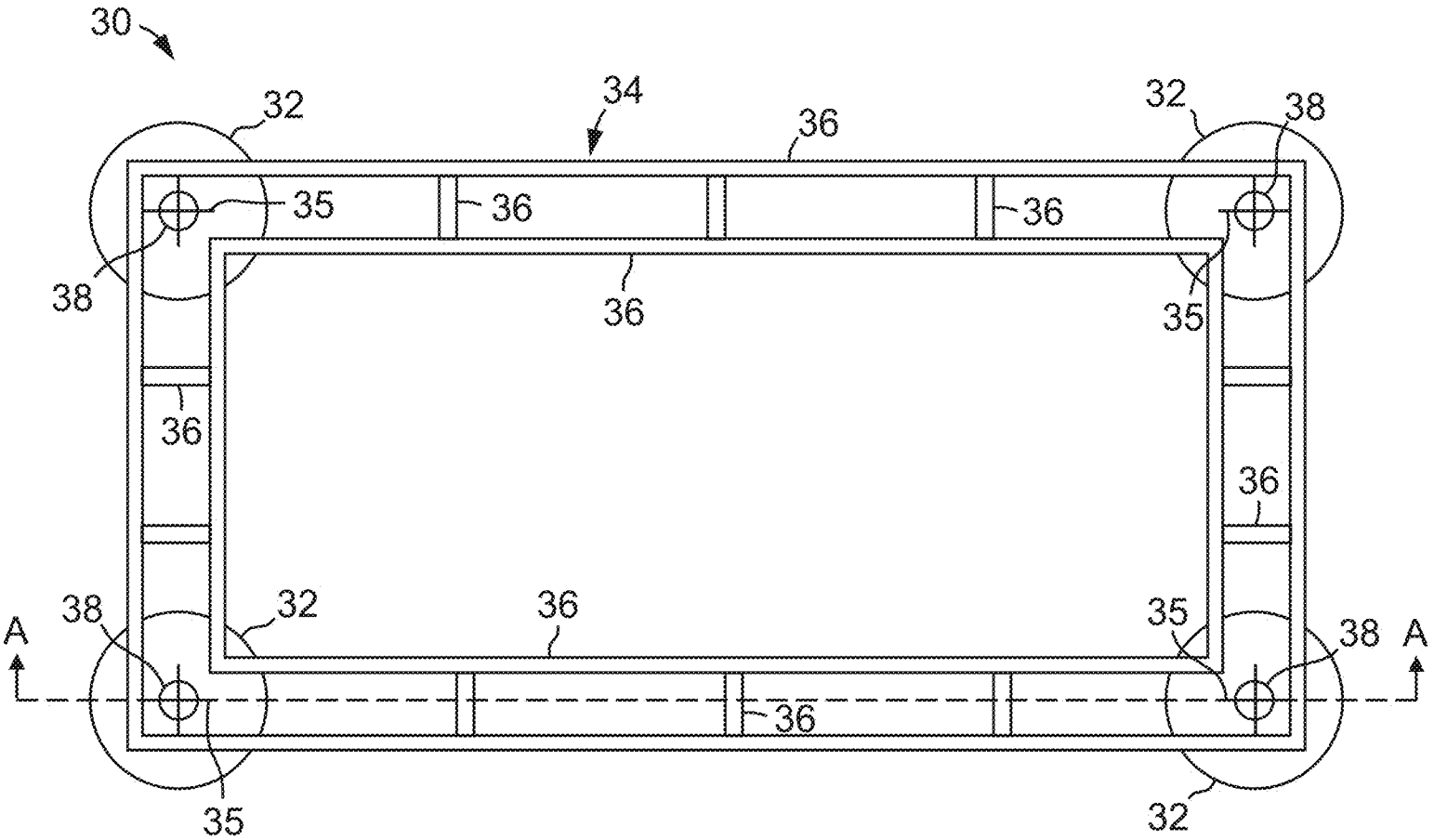
FIG. 5 is a top view of a foundation of the support system of FIGS. 1-4 according to some embodiments disclosed herein.
Figure 6:
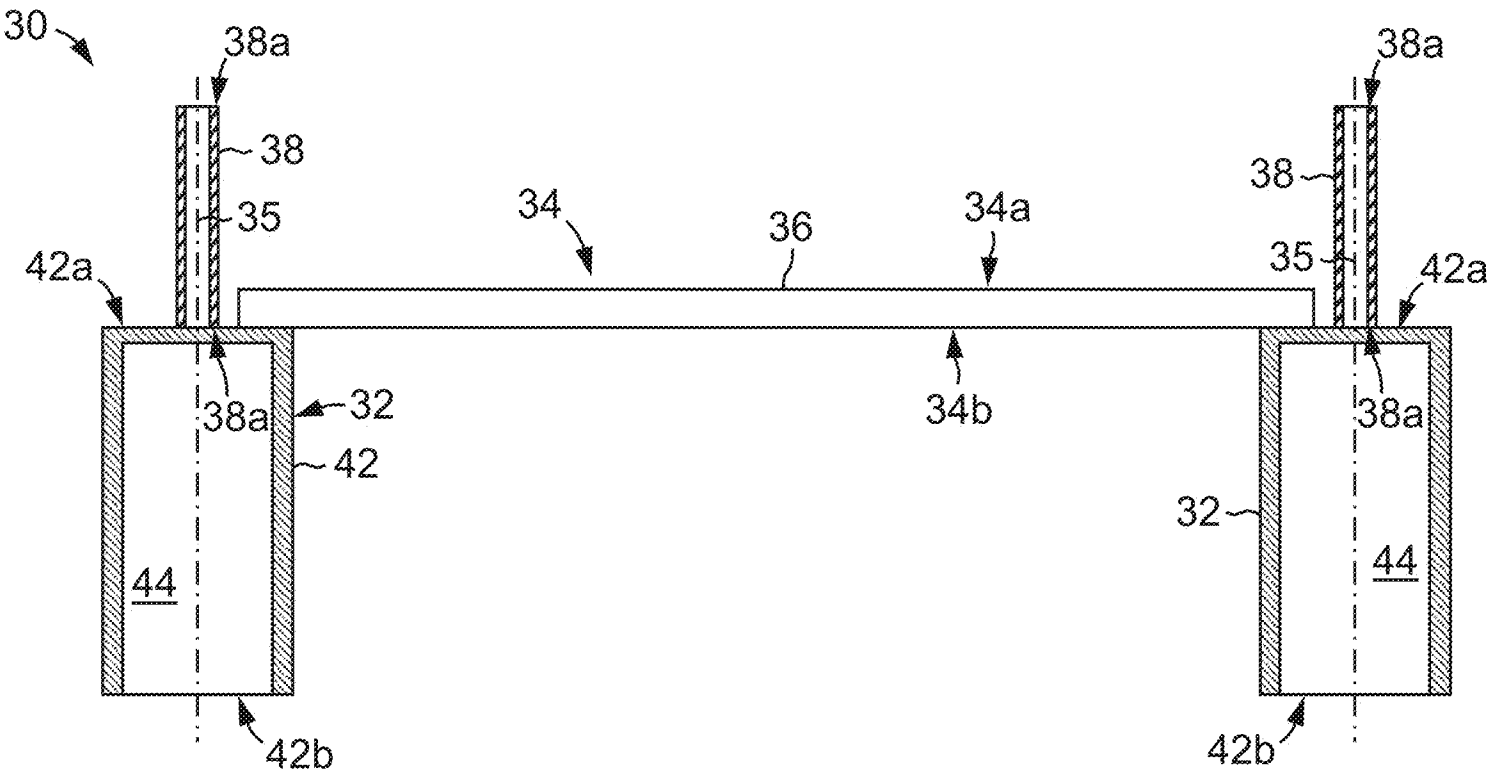
FIG. 6 is a cross-sectional view taken along section A-A in FIG. 5 according to some embodiments disclosed herein.

Referring now to FIGS. 5 and 6, the foundation 30 of the support system 40 is shown according to some embodiments. FIG. 5 shows a schematic top view of the foundation 30, and FIG. 6 shows a schematic cross-sectional view taken along section A-A in FIG. 5 according to some embodiments.

As shown in FIG. 5, the foundation 30 includes a frame 34 that comprises a plurality of elongate frame members 36 that are coupled to one another. The frame members 36 may be interconnected via any suitable system or method, such as welds, bolts (such as via brackets), threads, or combinations thereof. The frame 34 may be generally rectangular in shape in top view (such as the view of FIG. 5). However, other shapes are contemplated for the frame 34, and in some embodiments, the shape of the frame 34 may be at least partially dictated or determined based on the shape of the template 50.

The frame 34 may define a support, stage, or platform that is configured to engage with and support the template 50 when the template 50 is landed on the foundation 30 to define the support system 40 (FIG. 4). In particular, as best shown in FIG. 6, the frame 34 may include a first or upper side 34*a* and a second or lower side 34*b* opposite the upper side 34*a*. The lower side 34*b* may face downward and toward the sea floor 5 and the upper side 34*a* may face upward and toward the sea surface 7 when the foundation 30 is positioned in the subsea environment 6 (FIGS. 1-4). The upper side 34*a* may define the support, stage, or platform that is configured to engage with and support the template 50 during operation.

The lower side 34*b* of the frame 34 may be coupled to a plurality of suction anchors 32. As previously described, the suction anchors 32 may each include an open caisson that is configured to engage with the sea floor 5 (FIG. 2) during operation. In particular, each of the suction anchors 32 may comprise a body 42 having a central or longitudinal axis 35, a closed upper end 42*a*, and an open lower end 42*b* that is opposite the closed upper end 42*a* along the axis 35. The body 42 may define an internal cavity or cavity 44 that is accessible or open at the lower open end 42*b*. In some embodiments, the body 42 may comprise a cylindrical body; however, other shapes or cross-sections are contemplated, such as rectangular, square, polygonal, triangular, etc.

The closed upper end 42*a* of each of the suction anchors 32 may be coupled to the lower side 34*b* of the frame 34 so that the open lower ends 42*b* are projected axially away from the lower side 34*b* along the axes 35. The suction anchors 32 may be coupled to the frame 34 so that the axes 35 are parallel to one another.

As best shown in FIG. 5, in some embodiments, where the frame 34 has a generally rectangular shape, there are a total of four (4) suction anchors 32 with a suction anchor 32 positioned at (or proximate to) each of the four (4) corners of the frame 34. However, the number and arrangement of the suction anchors 32 may be different in various embodiments.

Referring still to FIGS. 5 and 6, connection piles 38 may be coupled to each of the closed upper ends 42*a* of the suction anchors 32. The connection piles 38 may comprise elongate tubular members including a first or upper end 38*a* and a second or lower end 38*b* opposite the upper end 38*a*. The lower ends 38*b* of the connection piles 38 may be coupled to the closed upper ends 42*a* of the suction anchors 32 so that the upper ends 38*a* extend axially upward from the closed upper ends 42*a* of the suction anchors 32 relative to the axes 35. Specifically, in some embodiments, for each of the suction anchors 32, the upper end 38*a* of a connection pile 38 may extend axially upward from the closed upper end 42*a* along the axis 35. Thus, in some embodiments, each of the connection piles 38 may be coaxially aligned with the central axis 35 of the corresponding suction anchor 32. In some embodiments, one or more of the connection piles 38 may not be coaxially aligned with the corresponding axes 35. For instance, one or more of the connection piles 38 may extend axially upward from the closed upper end 42*a* of the corresponding suction anchors 32 but may be axially misaligned (or radially offset or spaced) from the central axis 35.

In some embodiments, the axes 35 of the suction anchors 32 may be substantially aligned with the force of gravity and thus may be substantially vertically oriented. As a result, the connection piles 38, which may extend axially relative to axes 35 as previously described, may be described as "vertically extending" connection piles 38. In this context, a vertically extending connection pile 38 refers to a connection pile 38 that extends along or substantially along (such as +/−) 5° the vertical direction.

Figure 7:
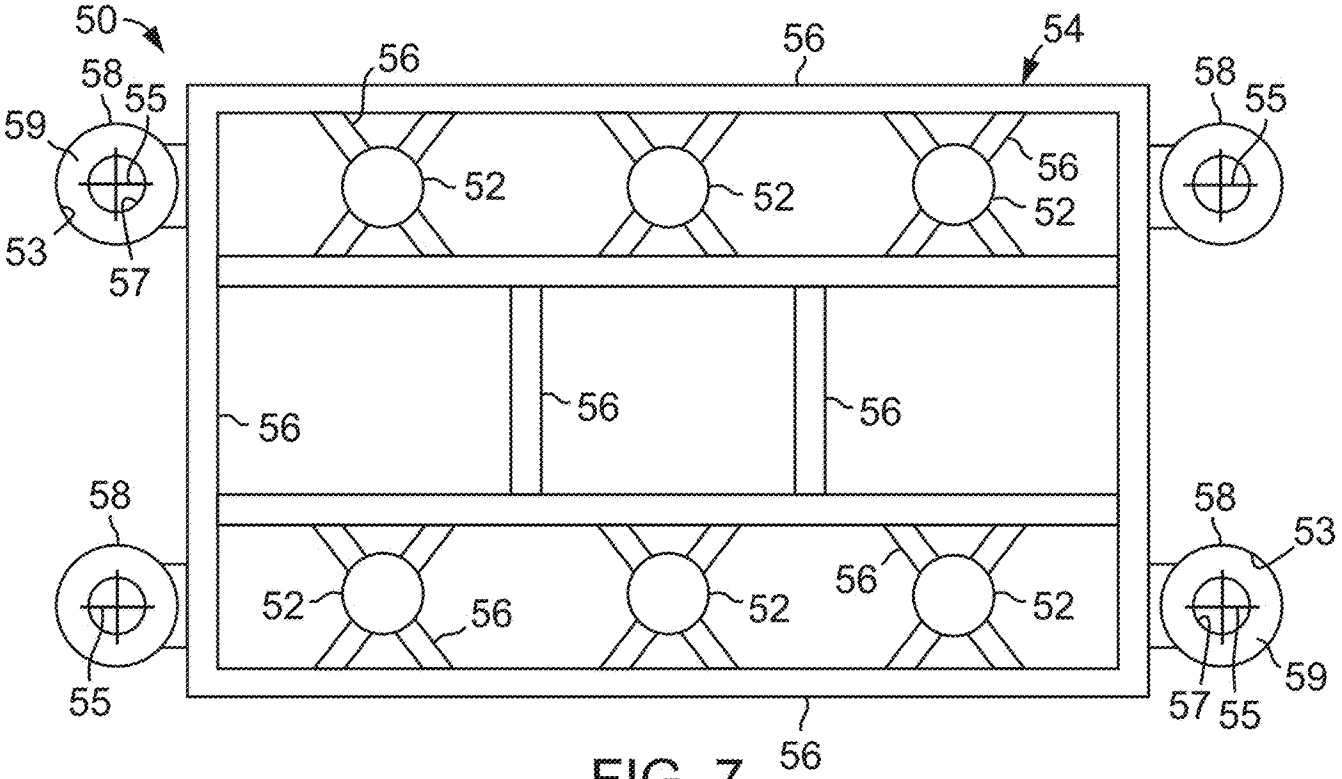
FIG. 7 is a top view of a template of the support system of FIGS. 1-4 according to some embodiments disclosed herein.
Figure 8:
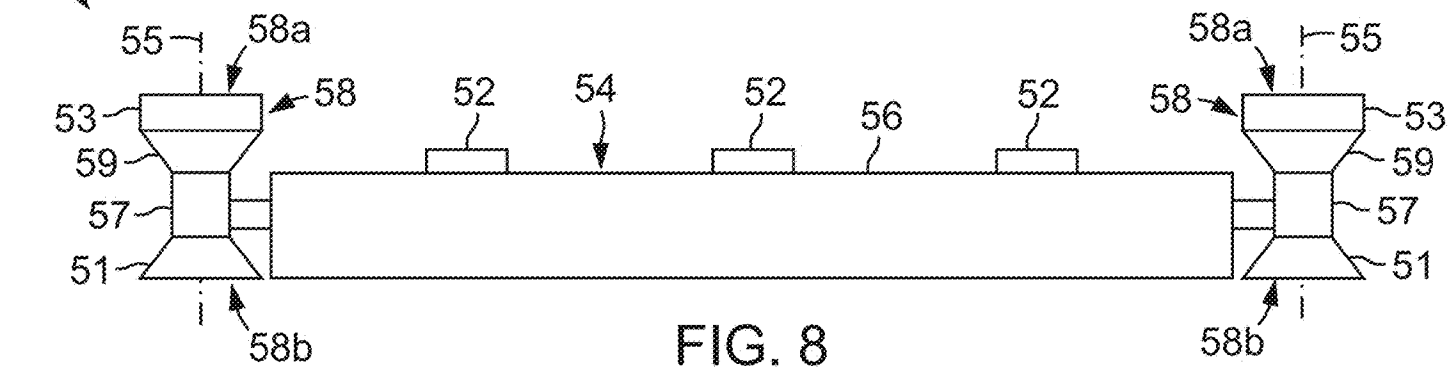
FIG. 8 is a side view of the template of FIG. 7 according to some embodiments disclosed herein.

Referring now to FIGS. 7 and 8, the template 50 of the support system 40 is shown according to some embodiments. FIG. 7 shows a schematic top view of the template 50, and FIG. 8 shows a schematic side view of the template 50 shown in FIG. 7 according to some embodiments.

As shown in FIG. 7, the template 50 includes a frame 54 that is comprised of a plurality of elongate frame members 56 that are coupled to one another. As was previously described for the frame members 36 of the frame 34 of foundation 30, the frame members 56 may be interconnected via any suitable system or method, such as welds, bolts (such as via brackets), threads, or combinations thereof. The frame 54 may be generally rectangular in shape in top view (such as the view of FIG. 7), so that the frame 54 may engage with and interface with the frame 34 (particularly the upper side 34*a*) of the foundation 30 during operations (FIGS. 5 and 6). However, other shapes are contemplated for the frame 54.

The frame 54 may include, define, or be coupled to a plurality of slots 52. Each of the slots 52 may comprise a housing (such as a cylindrical housing) that is configured to support a wellhead or conductor of a wellbore that may be extended into the sea floor 5 (FIGS. 1-4). In addition, each of the slots 52 may be configured to support other surface components associated with the wellbores (such as any of the example components previously described herein). Thus, after the template 50 is landed on the foundation 30 at the sea floor 5, a wellbore may be drilled through each of the slots 52 to form a plurality of wellbores into the sea floor 5 (FIGS. 1-4).

In addition, a plurality of connection sleeves 58 may be coupled to the frame 54, such as coupled to an outer perimeter of the frame 54. In some embodiments, the number and arrangement of the connection sleeves 58 may substantially match that of the connection piles 38 on the foundation 30 (FIGS. 5 and 6) as previously described.

As best shown in FIG. 8, each of the connection sleeves 58 may include a central or longitudinal axis 55, a first or upper end 58*a* and a second or lower end 58*b* that is opposite the upper end 58*a*. In addition, each connection sleeve 58 may include a central cylindrical portion 57 that is spaced between ends 58*a*, 58*b*, a first or upper frustoconical portion 59 that extends axially from the cylindrical portion 57 toward the upper end 58*a*, and a second or lower frustoconical portion 51 that extends axially from the cylindrical portion 57 to the lower end 58*b*. The frustoconical portions 59, 51 may each diverge or expand radially outward from the central axis 55 when moving axially away from the cylindrical portion 57. Thus, the upper frustoconical portion 59 may comprise an axially upward facing frustoconical portion that expands radially outward from the central axis 55 when moving axially from the cylindrical portion 57 toward the upper end 58*a*, and the lower frustoconical portion 51 may comprise an axially downward facing frustoconical portion that expands radially outward from the central axis 55 when moving axially from the cylindrical portion 57 toward the lower end 58*b*. In some embodiments, an upper cylindrical portion 53 may extend axially from the upper frustoconical portion 59 to the upper end 58*a*.

Figure 14:
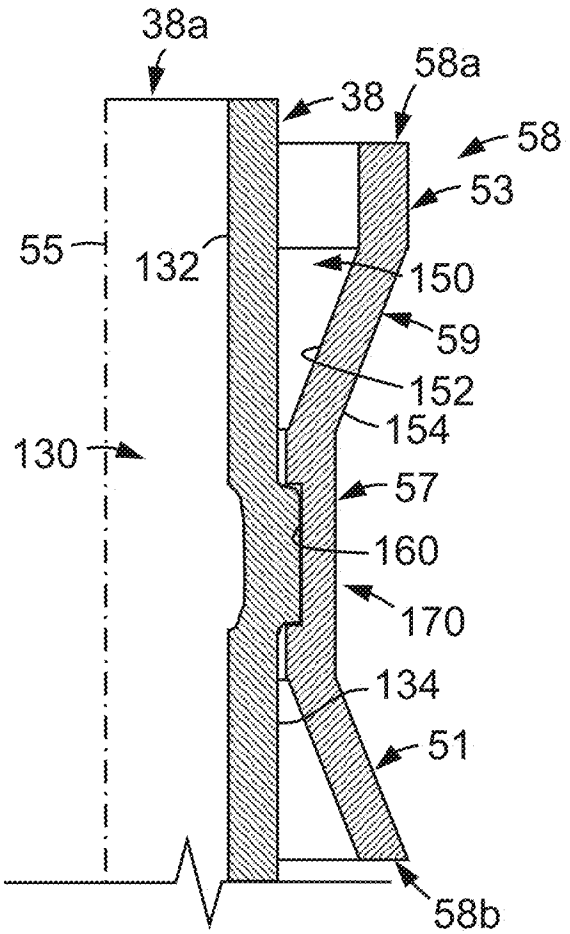
FIGS. 13 and 14 are sequential side cross-sectional views illustrating the formation of a mechanical lock between a connection pile and a connection sleeve of a support system for one or more wellbores according to some embodiments disclosed herein.
Figure 13:
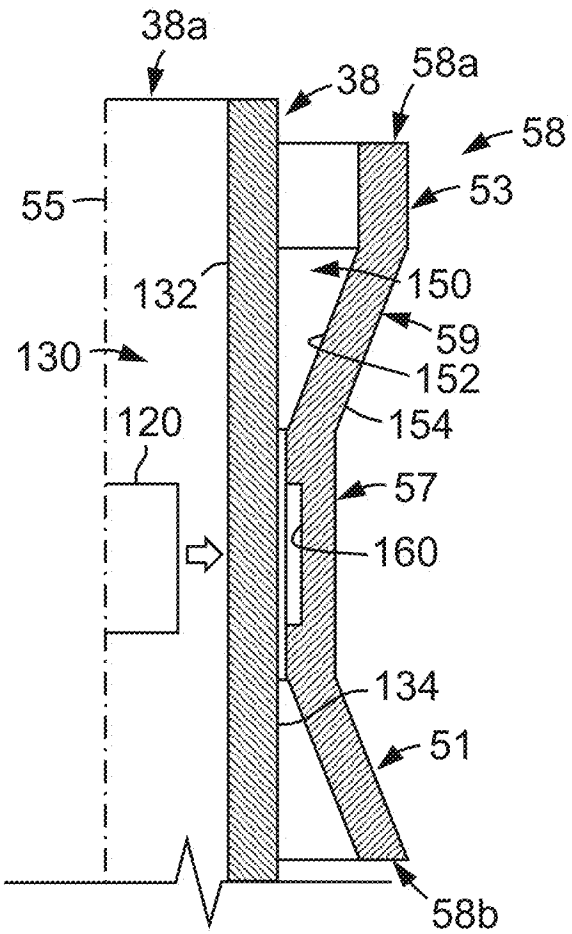

The portions 57, 59, 53, 51 may include corresponding inner and outer surfaces that extend between the ends 58*a*, 58*b* along axis 55 (such as radially inner surfaces 132, 134, 152, 154 shown in FIGS. 13 and 14 and described herein). Thus, the frustoconical portions 51, 59 may include radially inner and outer frustoconical surfaces that may extend parallel to one another. In addition, the cylindrical portions 57, 53 may include radially inner and outer cylindrical surfaces that may extend parallel to one another.

Without being limited to this or any other theory, the upper frustoconical portion 59 and upper cylindrical portion 53 may be configured to interface with a suitable tool for lifting the template 50 relative to the foundation 30 (such as for leveling the template 50 as described in more detail herein). In some embodiments, such tools are not utilized. As a result, in some embodiments, the upper cylindrical portion 53, and upper frustoconical portion 59 may be omitted, and the cylindrical portion 57 may extend axially from the lower frustoconical portion 51 to the upper end 58*a*.

As will be described in more detail herein, the lower frustoconical portions 51 of the connection sleeves 58 may function as funnels or guides for the connection pile 38 when the template 50 is landed on the foundation 30 during operations. As a result, the lower frustoconical portions 51 may be referred to herein as "guides" or "funnels."

Referring now to FIGS. 9-12, a process of installing the support system 40 on the sea floor 5 is shown according to some embodiments. In some embodiments, the process illustrated in FIGS. 9-12 may be included or incorporated into the process illustrated in FIGS. 1-4 as previously described. In describing the operations of the process shown in FIGS. 9-12, reference will be made to embodiments of the foundation 30 and template 50 shown in FIGS. 5-8 as previously described.

Figure 9:
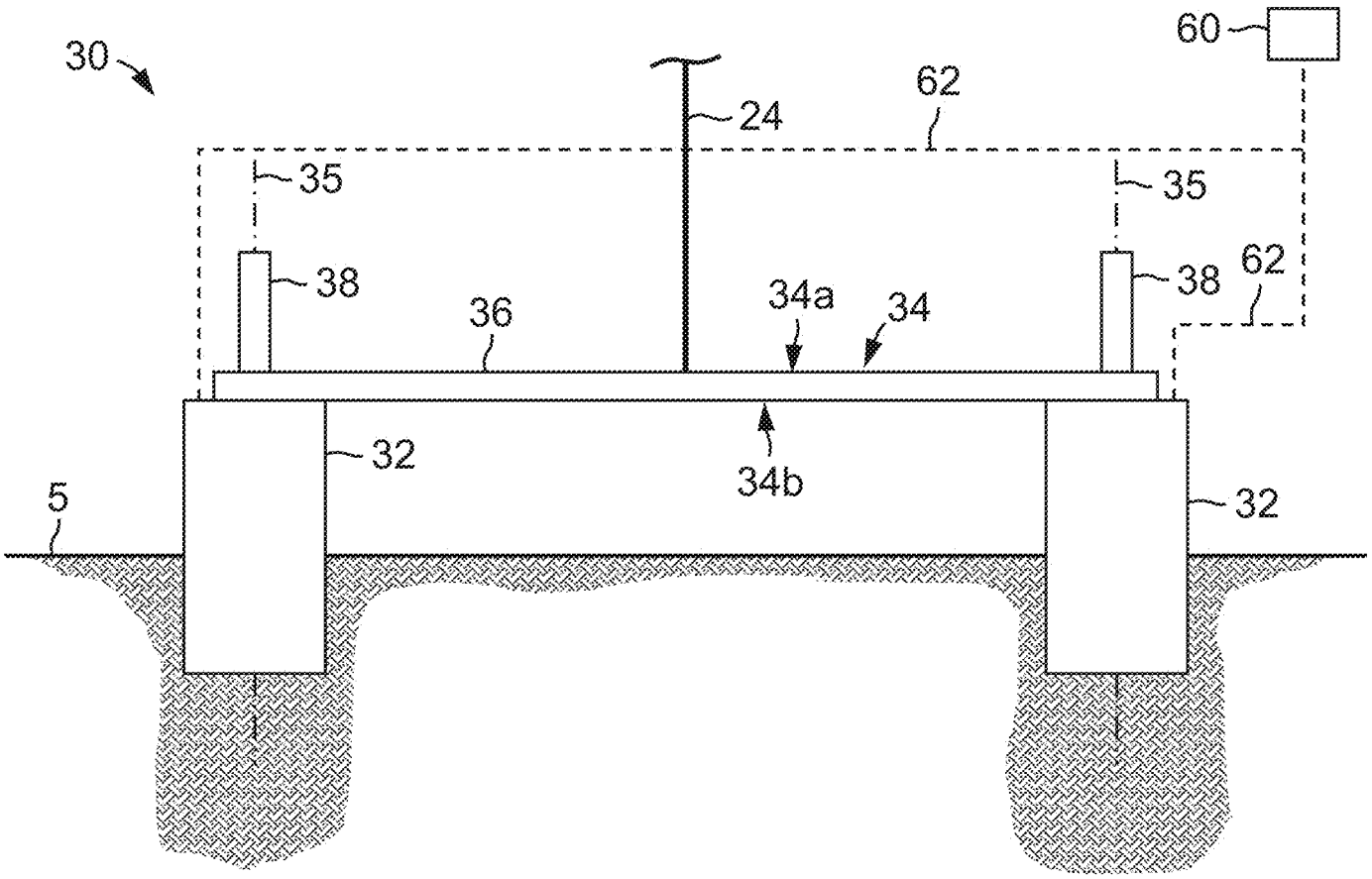
FIGS. 9-12 are sequential, schematic views of a method of installing a support system for one or more subsea wellbores on the sea floor according to some embodiments disclosed herein.
Figure 10:
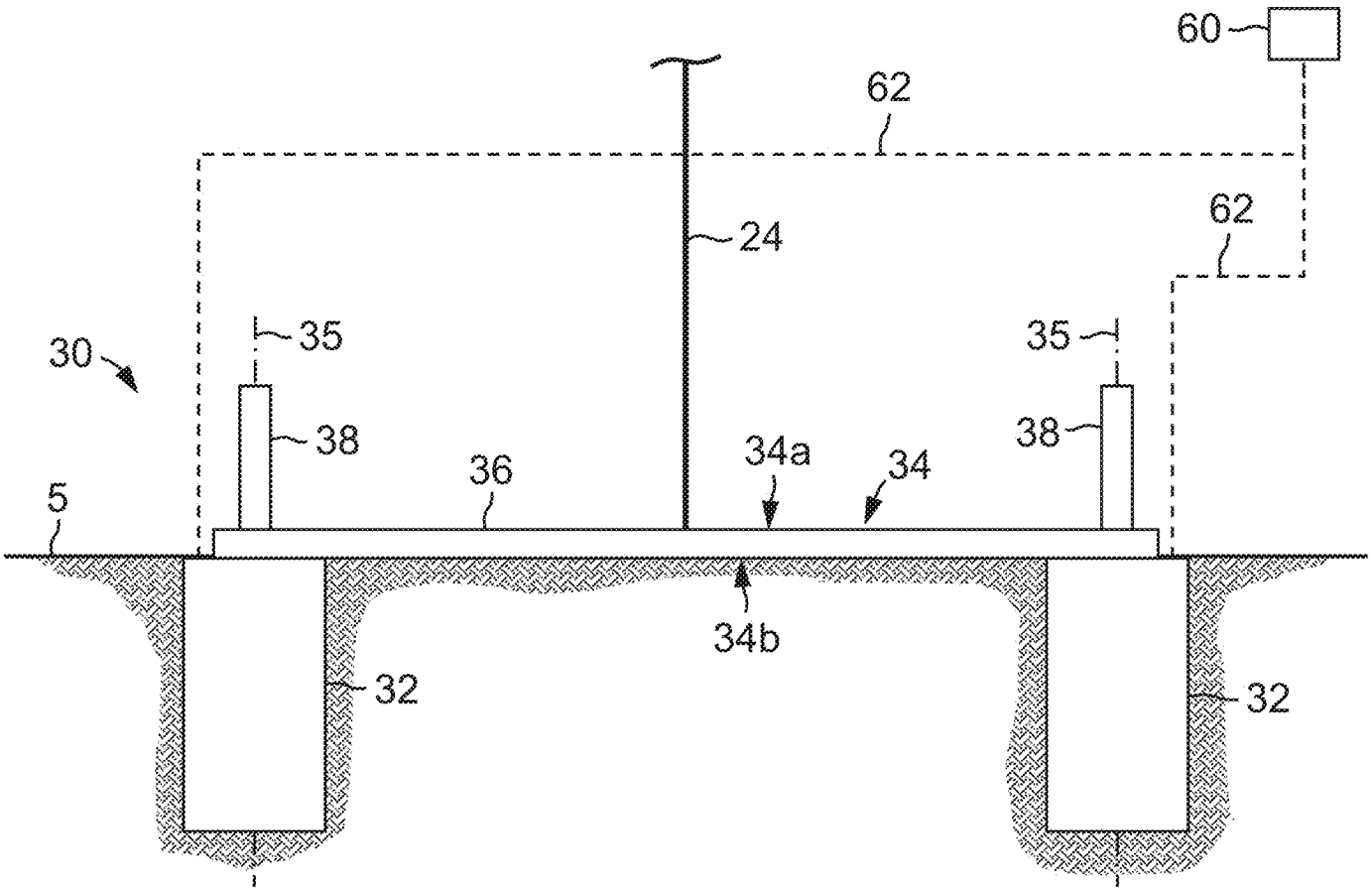

Referring to FIGS. 9 and 10, the foundation 30 may be lowered to the sea floor 5 via the line(s) 24 as previously described. Once the suction anchors 32 contact the sea floor 5, fluid (such as sea water) may be evacuated from the cavities 44 (FIG. 6) by use of a suitable vacuum source 60. In some embodiments, the vacuum source 60 may comprise one or more vacuum pumps that may be positioned in the subsea environment 6 or on the sea surface 7, such as on the vessel 20 or another vessel (FIGS. 1-4). In some embodiments, one or more conduits 62 (such as hoses, pipes, etc.) are coupled to the vacuum source 60 and the cavities 44 of the suction anchors 32 (FIG. 6) to evacuate the fluid therefrom. As shown in the sequence from FIG. 9 to FIG. 10, the evacuation of fluid from the cavities 44 may generate a suction force that pulls the suction anchors 32 axially downward and into the sea floor 5 along the axes 35 until the lower side 34*b* of the frame 34 is engaged with (or proximate to) the sea floor 5. Thereafter, the vacuum source 60 may be disconnected from the suction anchors 32 (such as by disconnecting the conduits 62 from the suction anchors 32).

As previously described, sinking or embedding the suction anchors 32 in the sea floor 5 may secure the foundation 30 to the sea floor 5 such that the foundation 30 may be configured to resist loads in a plurality of directions. For instance, the embedded suction anchors 32 may resist loads on the foundation 30 that are in a vertical direction (that is, aligned or substantially aligned with the force of gravity). Specifically, the embedded suction anchors 32 may resist both upward and downward vertical loads. In addition, the embedded suction anchors 32 may also resist loads that are directed in the lateral or horizontal direction (that is, a direction that is perpendicular or substantially perpendicular to the direction of gravity).

In some embodiments, the foundation 30 may be leveled as a result of or during the evacuation of fluid from the cavities 44 (FIG. 7) and the sinking of the anchors 32 into the sea floor 5 as previously described. Specifically, the foundation 30 may be leveled by selectively sinking each of the plurality of suction anchors 32 to different depths in the sea floor 5 via the vacuum source 60 as previously described. Leveling of the foundation 30 may comprise placing the frame 34 (and particularly the upper side 34*a*) in a horizontal or lateral plane that is perpendicular (or substantially perpendicular) to the direction of gravity. In some embodiments, the foundation 30 may be leveled so that the frame 34 (and particularly the upper side 34*a*) lies within a plane that is oriented within a desired tolerance of the lateral direction, such as within +/−5°, +/−3°, +/−2°, etc. of the lateral direction.

Figure 11:
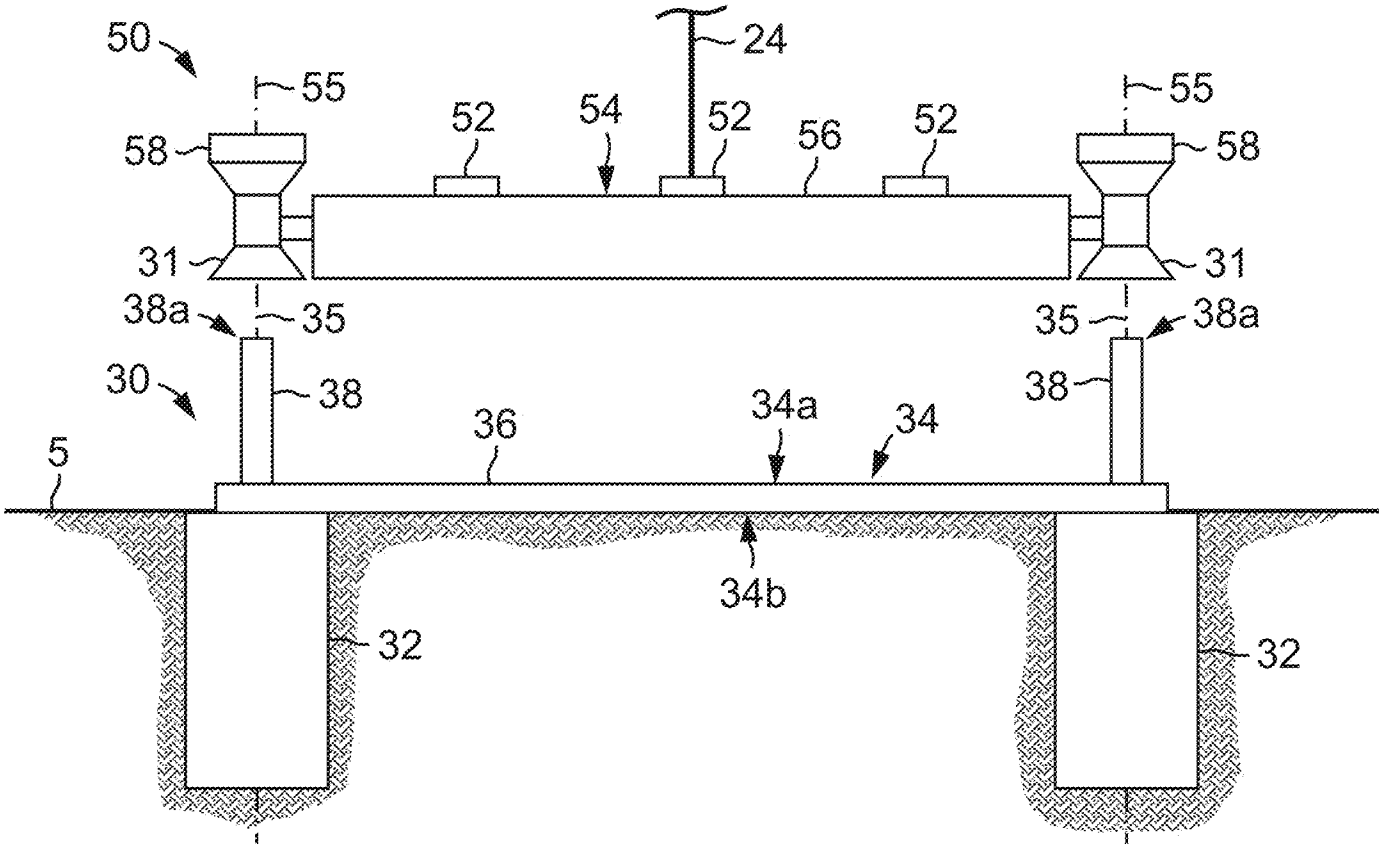
Figure 12:
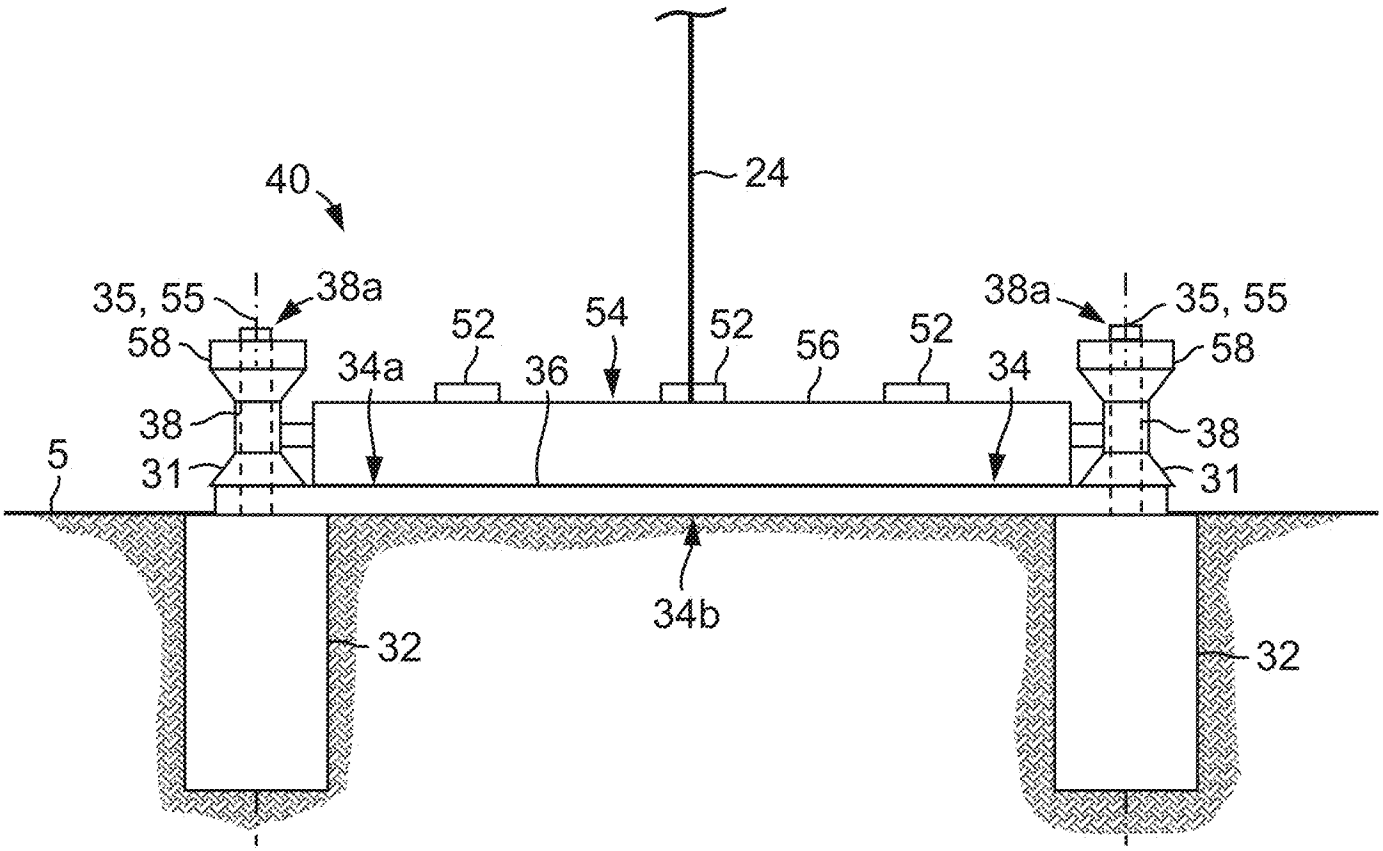

Referring now to FIGS. 11 and 12, after the foundation 30 is lowered and secured to the sea floor 5 as previously described, the template 50 may be lowered onto the foundation 30 via the line(s) 24. Specifically, the template 50 may be lowered so that the frame 54 of the template 50 is landed on the upper side 34*a* of the frame 34 of the foundation 30.

In addition, as the template 50 is lowered onto the foundation 30, the connection piles 38 may be aligned with and inserted into the connection sleeves 58. Specifically, the connection piles 38 may be coaxially aligned with the axes 55 of the connection sleeves 58 so that the upper ends 38*a* of the connection piles 38 may be axially advanced through the connection sleeves 58. As previously described, in some embodiments, the connection piles 38 may be aligned with the axes 35 of the suction anchors 32. As a result, in some embodiments, the axes 35 of the suction anchors 32 may be coaxially aligned with the axes 55 of the connection sleeves 58 when the template 50 is landed on the foundation 30.

As template 50 is lowered onto the foundation, the lower frustoconical portions 51 of the connection sleeves 58 may help to guide the upper ends 38*a* of the connection piles into the connection sleeves 58. Thus, the lower frustoconical portion 51 of connection sleeves 58 may help guide and center the template 50 onto the foundation 30 during operations.

Referring now to FIGS. 13 and 14, an enlarged cross-section of one of the connection piles 38 and sleeves 58 is shown according to some embodiments. As previously described, each of the connection piles 38 may comprise tubular members that have a radially inner surface 132 and a radially outer surface 134. The radially inner surface 132 may define an inner bore 130 within the connection pile 38. Similarly, the connection sleeve 58 may include a radially inner surface 152 and a radially outer surface 154. The radially inner surface 152 may define a throughbore 150 that axially extends between the ends 58*a*, 58*b* along axis 55. As the template 50 is lowered onto the foundation 30 as shown in FIGS. 11 and 12, the connection pile 38 may be received axially into the throughbore 150 of the connection sleeve 58 so that the radially outer surface 134 of the connection pile 38 radially opposes the radially inner surface 152 of the connection sleeve 58.

Once the template 50 is positioned on the foundation 30, a mechanical lock 170 may be formed or engaged between the connection piles 38 and connection sleeves 58 so that loads (such as vertical loads, lateral loads, etc.) may be transferred therebetween. For instance, as shown in the sequence from FIG. 13 to FIG. 14, in some embodiments, the connection pile 38 may be deformed or swaged into a groove 160 (or other suitable feature) on the connection sleeve 58.

Specifically, the groove 160 may be formed on the radially inner surface 152 within the cylindrical portion 57 of the connection sleeve 58. The groove 160 may extend circumferentially (such as partially or fully) about the axis 55. During operations, after the template 50 is landed on the foundation 30, and the connection piles 38 are received in the connection sleeves 58, a tool 120 (such as a swaging tool) may be inserted into the inner bore 130 of the connection pile 38 and radially actuated to engage with the radially inner surface 132. The engagement of the tool 120 and the radially inner surface 132 may locally expand the connection pile 38 radially outward and away from the axis 55 so that at least a portion of the radially outer surface 134 is deformed radially into the groove 160. The tool 120 may comprise any suitable device, system, or assembly that is configured to impart a radially outward force on to the radially inner surface 132 of the connection pile 38 as previously described. For instance, the tool 120 may include one or more rams, sleeves, or other actuatable or expandable elements.

The engagement between the deformed radially outer surface 134 within the groove 160 may define a mechanical lock 170 between the connection pile 38 and connection sleeve 58 that may resist loads (such as vertical loads and lateral loads). More particularly, the mechanical lock 170 illustrated in FIG. 14 may comprise a swaged connection between the connection pile 38 and connection sleeve 58. When a similar mechanical lock 170 is formed between each (or at least some) of the connection piles 38 and connection sleeves 58, the template 50 may be secured to the foundation 30 so that loads borne by the template 50 may be freely transferred to the foundation 30, via the mechanical locks 170, and ultimately into the sea floor 5 via the suction anchors 32.

While the illustrated mechanical lock 170 of FIG. 14 is a swaged connection, it should be appreciated that other mechanical locks 170 are contemplated between the connection piles 38 and connection sleeves 58 in various embodiments. For instance, in some embodiments, the mechanical lock 170 (or at least one or more of the mechanical locks 170) may be formed by radially deforming the connection sleeve 58 into the connection pile 38 (or a groove or other feature formed thereon). In some embodiments, the mechanical lock 170 may be formed by a clamp or other mechanical device that is engaged to and between the connection pile 38 and connection sleeve 58. In some embodiments, the mechanical lock 170 may be formed by welding the connection pile 38 to the connection sleeve 58. Regardless of the particular mechanical lock 170 that is used, the mechanical lock 170 may secure the connection pile 38 to the sleeve 58 to resist loads in both the vertical and lateral directions as previously described.

As previously described, the foundation 30 may be leveled when landing the foundation 30 on the sea floor 5. As a result, in some embodiments, the template 50 may also be level when it is landed on the frame 34 of foundation 30 (FIGS. 11 and 12). However, in some embodiments, landing the template 50 onto the foundation 30 may cause the foundation 30 to settle non-uniformly into the sea floor 5 so that further leveling of the template 50 relative to the foundation 30 may be desired. In some embodiments, the template 50 may be leveled by selectively lifting one or more of the connection sleeves 58 (or portions of the frame 54 that are proximate the sleeves 58) relative to the foundation 30 to level the frame 54 within a laterally oriented plane as previously described. In some embodiments, selectively lifting the connection sleeves 58 (or proximate portions of the frame 54) may be accomplished via lines (e.g., line 24) and one or more lifting systems (such as lifting systems on the sea surface 7 or within the subsea environment 6). In some embodiments, selectively lifting the connection sleeves 58 (or portions of the frame 54) may be accomplished by use of lifting devices (such as cylinders or other actuators) that are engaged to and between the connection sleeves 58 and connection piles 38. For instance, such a lifting device may pull upward on the upper end 58*a* of a connection sleeve 58 (specifically the upper cylindrical portion 53) while pushing downward on the upper end 38*a* of the connection pile 38. Once the template 50 has been leveled, the mechanical locks 170 may be formed (such as via any one or more of the methods described herein) to thereby maintain the relative positioning between the template 50 and foundation 30.

As explained above and reiterated below, the present disclosure includes, without limitation, the following Examples.

Example 1: A subsea support system comprising: a foundation comprising: a frame; an elongate connection pile; a template that is configured to be lowered to a sea floor separately from the foundation, where the template comprises: one or more slots, each of the one or more slots being configured to position a subsea wellbore on the sea floor; and a connection sleeve that is arranged so that when the template is landed on the foundation on the sea floor, the connection pile is received in the connection sleeve.

Example 2: The subsea support system of any of the Examples, wherein the foundation comprises one or more suction anchors that are coupled to the frame.

Example 3: The subsea support system of any of the Examples, wherein the connection pile is coupled to an upper end of one of the one or more suction anchors.

Example 4: The subsea support system of any of the Examples, further comprising a mechanical lock between the connection pile and the connection sleeve that is configured to rigidly secure the template to the foundation.

Example 5: The subsea support system of any of the Examples, wherein the connection pile comprises a tubular member having an inner bore, and wherein the connection sleeve includes a groove, and wherein the connection pile is configured to be swaged into the groove to define the mechanical lock.

Example 6: The subsea support system of any of the Examples, wherein the connection sleeve includes an upper end, a lower end, and a funnel defined at the lower end that is configured to guide the connection pile into the connection sleeve as the template is landed on the foundation on the sea floor.

Example 7: The subsea support system of any of the Examples, wherein the connection sleeve includes a cylindrical portion, and an upper frustoconical portion that extends from the cylindrical portion toward the upper end.

Example 8: The subsea support system of any of the Examples, wherein the groove is formed in the cylindrical portion.

Example 9: A method of installing a subsea support system, the method comprising: (a) lowering a foundation to a sea floor, wherein the foundation includes a frame; (b) securing the foundation on the sea floor so that the foundation is configured to resist loads in a vertical direction and a lateral direction; (c) lowering a template to the sea floor after (a), where the template includes one or more slots, each of the one or more slots being configured to position a subsea wellbore on the sea floor; (d) landing the template on the frame of the foundation; and (e) forming a mechanical lock between the template and the foundation after (d) to rigidly secure the template to the foundation.

Example 10: The method of any of the Examples, wherein (b) further comprises sinking one or more suction anchors, coupled to the frame of the foundation, into the sea floor.

Example 11: The method of any of the Examples, wherein (d) further comprises inserting one or more connection piles, that are coupled to the foundation, into one or more connection sleeves, that are coupled to the template.

Example 12: The method of any of the Examples, wherein (d) further comprises guiding an upper end of the one or more connection piles into the one or more connection sleeves by use of a funnel on a lower end of each of the one or more connection sleeves.

Example 13: The method of any of the Examples, wherein (e) further comprises forming the mechanical lock between the one or more connection piles and the one or more connection sleeves.

Example 14: The method of any of the Examples, wherein (e) further comprises swaging the one or more connection piles into the one or more connection sleeves.

Example 15: The method of any of the Examples, further comprising: (f) leveling the foundation before (c); and (g) leveling the template relative to the foundation after (c) and before (e).

Example 16: A subsea support system comprising: a foundation comprising: a frame; a plurality of vertically extending connection piles; a template landed on the frame of the foundation, where the template comprises: a plurality of slots, that are each configured to position a subsea wellbore on a sea floor; and a plurality of connection sleeves, where the plurality of vertically extending connection piles are inserted into the plurality of connection sleeves to align the template on the foundation; and a plurality of mechanical locks formed between the plurality of connection piles and the plurality of connection sleeves to rigidly secure the template to the foundation.

Example 17: The subsea support system of any of the Examples, wherein the foundation comprises a plurality of suction anchors that are coupled to the frame, and wherein each of the plurality of connection piles is coupled to an upper end of a corresponding one of the plurality of suction anchors.

Example 18: The subsea support system of any of the Examples, wherein each of the plurality of the connection piles comprises a tubular member having an inner bore.

Example 19: The subsea support system of any of the Examples, wherein each of the plurality of connection sleeves includes a groove, and wherein each of the plurality of mechanical locks comprises a swaged connection between a corresponding one of the plurality of connection piles and the groove of a corresponding one of the plurality of connection sleeves.

Example 20: The subsea support system of any of the Examples, wherein each of the plurality of connection sleeves includes an upper end, a lower end, and a funnel defined at the lower end that is configured to guide the corresponding connection pile into the connection sleeve as the template is landed on the foundation on the sea floor.

Example 21: The subsea support system of any of the Examples, wherein each of the plurality of connection sleeves includes a cylindrical portion, and an upper frustoconical portion that extends from the cylindrical portion toward the upper end, and wherein the groove is formed in the cylindrical portion.

Embodiments disclosed herein are directed to subsea support systems for subsea wellbores that include a subsea template and a foundation that may be lowered to the sea floor separately from one another. In some embodiments, the foundation may include one or more structures or components that are configured to engage with the sea floor to resist the various loads previously described above (such as vertical and horizontal loads). The template may be landed on top of the foundation in a separate lifting operation. Once the template is landed on the foundation, a suitable mechanical lock may be formed, defined, or engaged therebetween so that subsequent loads borne by the template may be readily transferred to the foundation and ultimately the sea floor. Thus, by use of the embodiments disclosed herein, a subsea support system may sufficiently support one or more wellbores on a sea floor comprised of softer soils and may avoid the increased lifting weights that may be typically associated with the installation of such systems.

The preceding discussion is directed to various embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the preceding discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used to refer to a stated value, mean within a range of plus or minus 10% of the stated value.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A subsea support system comprising:

a foundation comprising:

a frame; and an elongate connection pile; and a template that is configured to be lowered to a sea floor separately from the foundation, wherein the template comprises:

one or more slots, each of the one or more slots being configured to position a subsea wellbore on the sea floor; and a connection sleeve that is arranged so that when the template is landed on the foundation on the sea floor, the connection pile is received in the connection sleeve, wherein the connection sleeve comprises:

a cylindrical portion;

an upper frustoconical portion extending axially from the cylindrical portion toward an upper end of the connection sleeve, wherein the upper frustoconical portion diverges radially outward from a central axis of the connection sleeve along an axial direction from the cylindrical portion toward the upper end; and an upper cylindrical portion extending axially from the upper frustoconical portion to the upper end of the connection sleeve;

wherein the upper frustoconical portion and the upper cylindrical portion are configured to interface with a tool for lifting the template relative to the foundation.

2. The subsea support system of claim 1, wherein the foundation comprises one or more suction anchors that are coupled to the frame.

3. The subsea support system of claim 2, wherein the connection pile is coupled to an upper end of one of the one or more suction anchors.

4. The subsea support system of claim 2, further comprising a mechanical lock between the connection pile and the connection sleeve that is configured to rigidly secure the template to the foundation.

5. The subsea support system of claim 4, wherein the connection pile comprises a tubular member having an inner bore, and wherein the connection sleeve includes a groove, and wherein the connection pile is configured to be swaged into the groove to define the mechanical lock.

6. The subsea support system of claim 5, wherein the connection sleeve includes a funnel defined at a lower end that is configured to guide the connection pile into the connection sleeve as the template is landed on the foundation on the sea floor.

7. The subsea support system of claim 5, wherein the groove is formed in the cylindrical portion.

8. A method of installing a subsea support system, the method comprising:

(a) lowering a foundation to a sea floor, wherein the foundation includes a frame;

(b) securing the foundation on the sea floor so that the foundation is configured to resist loads in a vertical direction and a lateral direction;

(c) lowering a template to the sea floor after (a), wherein the template includes one or more slots and one or more connection sleeves, each of the one or more slots being configured to position a subsea wellbore on the sea floor, each of the one or more connection sleeves comprising:

a cylindrical portion;

an upper frustoconical portion extending axially from the cylindrical portion toward an upper end of the connection sleeve, wherein the upper frustoconical portion diverges radially outward from a central axis of the connection sleeve along an axial direction from the cylindrical portion toward the upper end; and an upper cylindrical portion extending axially from the upper frustoconical portion to the upper end of the connection sleeve, wherein the upper frustoconical portion and the upper cylindrical portion are configured to interface with a tool for lowering the template;

(d) landing the template on the frame of the foundation; and (e) forming a mechanical lock between the template and the foundation after (d) to rigidly secure the template to the foundation.

9. The method of claim 8, wherein (b) further comprises sinking one or more suction anchors, coupled to the frame of the foundation, into the sea floor.

10. The method of claim 9, wherein (d) further comprises inserting one or more connection piles that are coupled to the foundation into the one or more connection sleeves that are coupled to the template.

11. The method of claim 10, wherein (d) further comprises guiding an upper end of the one or more connection piles into the one or more connection sleeves by use of a funnel on a lower end of each of the one or more connection sleeves.

12. The method of claim 10, wherein (e) further comprises forming the mechanical lock between the one or more connection piles and the one or more connection sleeves.

13. The method of claim 12, wherein (e) further comprises swaging the one or more connection piles into the one or more connection sleeves.

14. A subsea support system comprising:

a foundation comprising:

a frame; and a plurality of vertically extending connection piles;

a template landed on the frame of the foundation, wherein the template comprises:

a plurality of slots that are each configured to position a subsea wellbore on a sea floor; and a plurality of connection sleeves, wherein the plurality of vertically extending connection piles are inserted into the plurality of connection sleeves to align the template on the foundation, each of the plurality of connection sleeves comprising:

a cylindrical portion;

an upper frustoconical portion extending axially from the cylindrical portion toward an upper end of the connection sleeve, wherein the upper frustoconical portion diverges radially outward from a central axis of the connection sleeve along an axial direction from the cylindrical portion toward the upper end; and an upper cylindrical portion extending axially from the upper frustoconical portion to the upper end of the connection sleeve, wherein the upper frustoconical portion and the upper cylindrical portion are configured to interface with a tool for lifting the template relative to the foundation; and a plurality of mechanical locks formed between the plurality of connection piles and the plurality of connection sleeves to rigidly secure the template to the foundation.

15. The subsea support system of claim 14, wherein the foundation comprises a plurality of suction anchors that are coupled to the frame, and wherein each of the plurality of connection piles is coupled to an upper end of a corresponding one of the plurality of suction anchors.

16. The subsea support system of claim 15, wherein each of the plurality of connection piles comprises a tubular member having an inner bore.

17. The subsea support system of claim 16, wherein each of the plurality of connection sleeves includes a groove, and wherein each of the plurality of mechanical locks comprises a swaged connection between a corresponding one of the plurality of connection piles and the groove of a corresponding one of the plurality of connection sleeves.

18. The subsea support system of claim 17, wherein each of the plurality of connection sleeves includes a funnel defined at a lower end that is configured to guide the corresponding connection pile into the connection sleeve as the template is landed on the foundation on the sea floor.

19. The subsea support system of claim 18, wherein the groove is formed in the cylindrical portion.

* * * * *